US005201593A

United States Patent [19]

Yamagata

[11] Patent Number: 5,201,593

[45] Date of Patent: Apr. 13, 1993

[54] PRINTING APPARATUS WITH MULTIPLE RIBBON CASSETTES

[75] Inventor: Takeshi Yamagata, Yokohama, Japan

[73] Assignee: Kabushiki Kaisha Toshiba, Kawasaki, Japan

[21] Appl. No.: 796,802

[22] Filed: Nov. 25, 1991

[30] Foreign Application Priority Data

Nov. 27, 1990 [JP] Japan ..... 2-324299

[51] Int. Cl.[5] ..... B41J 33/54

[52] U.S. Cl. ..... 400/214; 400/206; 400/206.2

[58] Field of Search ..... 400/194, 196, 206, 206.2, 400/206.3, 207, 208, 208.1, 214, 120, 185, 187, 216.1, 216.2, 235

[56] References Cited

U.S. PATENT DOCUMENTS

| | | | |
|---|---|---|---|
| 4,469,459 | 9/1984 | Trezise et al. | 400/216.1 |
| 4,504,160 | 3/1985 | Payne et al. | 400/196.1 |
| 4,564,303 | 1/1986 | Rosenberg et al. | 400/206.3 |
| 4,606,662 | 8/1986 | Komplin | 400/214 |
| 4,694,305 | 9/1987 | Shiomi et al. | 400/206 |
| 4,758,108 | 7/1988 | Nakai et al. | 400/697.1 |

FOREIGN PATENT DOCUMENTS

| | | | |
|---|---|---|---|
| 0163932 | 12/1985 | European Pat. Off. . | |
| 225780 | 11/1985 | Japan | 400/206 |

OTHER PUBLICATIONS

IBM Technical Disclosure Bulletin, "Multicolor Matrix Impact Printer" J. H. Meier, vol. 21, No. 11, Apr. 1979 pp. 4448–4451.

IBM Technical Disclosure Bulletin, "Multiple Ribbon Cartridge Color Printer" Meier, Pimbley and Rosenthal, vol. 22, No. 10, Mar. 1980, pp. 4481–4482.

*Primary Examiner*—David A. Wiecking

*Attorney, Agent, or Firm*—Cushman, Darby & Cushman

[57] ABSTRACT

A printing apparatus has a driving motor being rotatable in the forward and backward directions, a first gear for receiving the torque of the motor, a swaying arm secured to an end of the first gear, a printing unit including a plurality of ribbon cassettes superposed on one another, and convey mechanism for conveying document or passbook to the printing unit. The printing unit comprises a taking-up gear for independently taking-up ink ribbons contained in ribbon cassettes, a cam mechanism for selectively shifting the ink ribbons to allow one to pass a printing head, and a second gear for transmitting the torque of the motor from the first gear to the taking-up gear or to the cam mechanism in accordance with sway of the swaying arm.

10 Claims, 5 Drawing Sheets

PRINTING APPARATUS WITH MULTIPLE RIBBON CASSETTES

BACKGROUND OF THE INVENTION

1. Field of the Invention

This invention relates to a printing apparatus with multiple ribbon cassettes to be used as a passbook printer unit for use in an automated cash-depositing-/withdrawing machine, and more particularly to an improved handling system capable of multiple ribbon cassettes.

2. Description of the Related Art

In recent years, with the spread of an Automated Teller Machine (hereinafter called the "ATM") such as an automated cash-depositing/withdrawing machine, automation of teller's services at counters of banks and the like has been developed rapidly, and further such services have become wealthy of variety. Under these circumstances, various types of passbook handling systems have been put to use, some of which employ multiple color (e.g. black and red) printers.

These conventional devices employing multiple color printers each have shifting and taking-up mechanisms for ink ribbons of different colors. The shifting mechanism includes a plurality of shift means for causing a required one of the ink ribbons to pass its printing head. The taking-up mechanism has driving motors for taking-up each of ribbons to a reel, respectively. A plurality of ribbons are contained in one cassette.

However, in the conventional multiple color printers, the driving motors of the shift mechanism are provided for shifting each of ribbons, so that the printer is inevitably large and hence expensive.

Further, since two or more ink ribbons of different colors are contained in one cassette, the cassette must be made large in size in order to receive such long ribbons as can be used for a long time.

In addition, even if the user wants to elongate a black ribbon only, the other ribbons must be elongated accordingly, and therefore a large size cassette is required.

SUMMARY OF THE INVENTION

It is the object of the invention to provide a low cost and compact recording sheet printer.

According to an aspect of the invention, a printing apparatus comprises: printing means having a plurality of ribbon cassettes, so that one of the ribbon cassettes is disposed in a printing position whereby an image may be printed on a recording sheet; taking-up means for taking up ink ribbons contained in the ribbon cassettes; shifting means for shifting the ribbon cassettes so that the another ink ribbon is moved against a printing head incorporated in the printing means; and driving means to be used for driving the taking-up means and the shifting means.

According to an aspect of the invention, a printing apparatus comprises: driving means being rotatable in the forward and backward directions; a first transmission member for receiving the torque of the driving means; a swaying arm provided at an end of the first transmission member; printing means, having a plurality of ribbon cassettes, so that one of the ribbon cassettes is disposed in a printing position whereby an image may be printed on a recording sheets the ribbon cassettes being connected to one another such that they can be superposed on one another; taking-up means for taking up ink ribbons contained in the ribbon cassettes; shifting means for shifting the ribbon cassettes so that the another ink ribbon is moved against a printing head incorporated in the printing means; and a second transmission member provided at a free end of the swaying arm, for transmitting the torque, transmitted from the first transmission member, to one of the taking-up means and shifting means in accordance with sway of the swaying arm.

According to another aspect of the invention, a printing apparatus comprises: a pair of ribbon cassettes each including a ribbon having printing agents transferable to a recording sheet which thereby form an image upon the recording sheet; mounting means for mounting the pair of ribbon cassettes so that one of the ribbon cassettes is located in a print position whereby an image may be formed upon a recording sheet; shifting means for shifting the pair of ribbon cassettes so that the other ribbon cassettes is located in a print position whereby an image may be formed upon a recording sheet; taking up means for taking up the ribbons contained in the pair of ribbon cassettes; means for generating a driving force in forward direction and backward direction; first transmission means for transmitting the driving force in forward direction to the taking up means; and second transmission means for transmitting the driving force in backward direction to the shifting means.

In the printing apparatus of the invention, a plurality of ribbon cassettes are provided for ink ribbons of different colors, respectively, and are superposed on one another, so that the required size of each cassette is small, which saves the space required for arranging the cassettes. Further, since one driving source is used for driving taking-up means and shifting means, the space required for the driving source is small, which enables the printer to be made compact.

Preferably, a cam mechanism having a face cam, a force pin, and a blade spring is used as the shifting means for selectively shifting the ink ribbons. In this case, it is desirable to construct such that the force pin is urged by the blade spring against the face of the cam, and that the ribbon cassettes are displaced in accordance with movement of the force pin.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The invention will be explained in detail with reference to the accompanying drawings showing preferred embodiments thereof.

Figure 1:
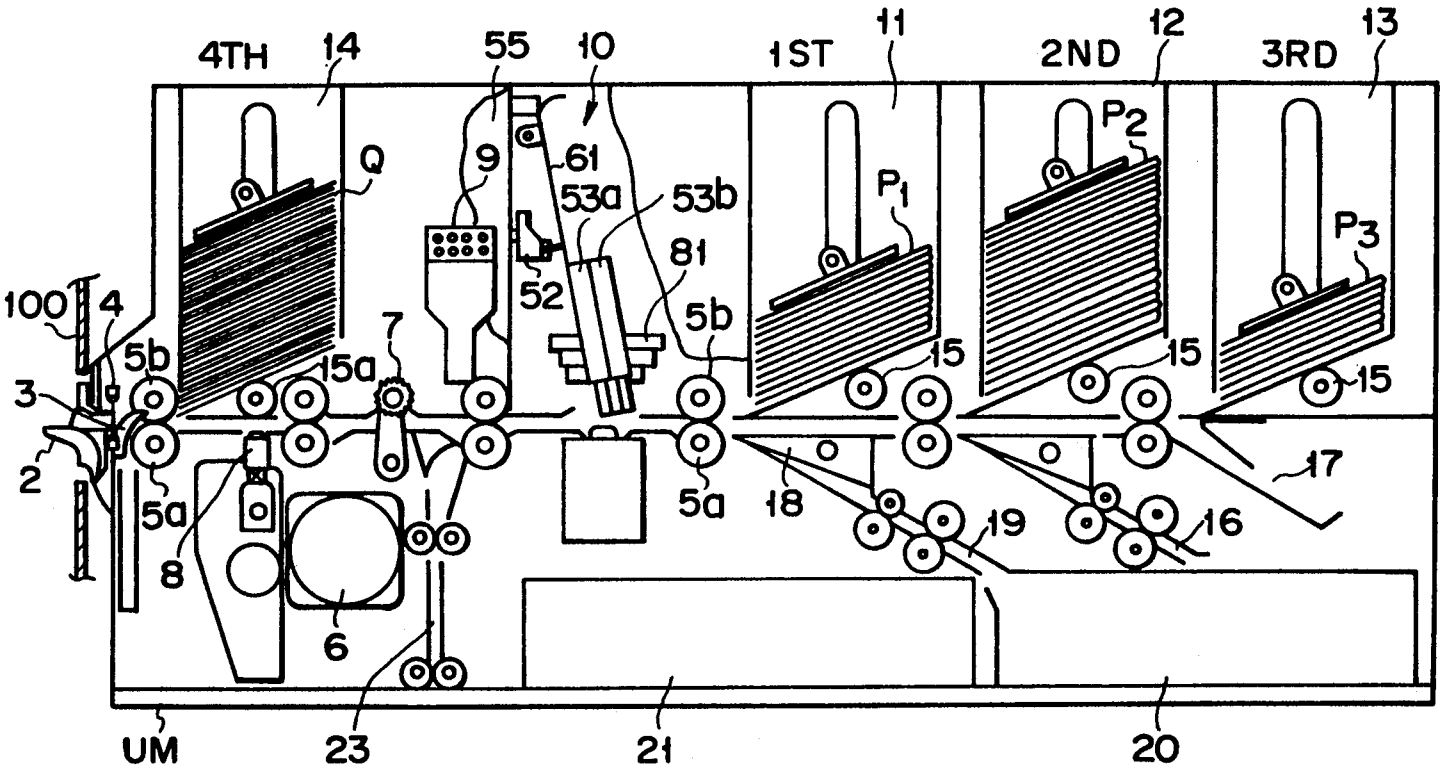
FIG. 1 is a longitudinal sectional view, schematically showing a printer system serving as recording sheets printing apparatus.

As is shown in FIG. 1, a passbook printer system (i.e., document and passbook handling system) UM is coupled with a main body 100 of an ATM, and a passbook P and a single document Q are to be guided from the ATM main body 100 to the device UM (or vice versa), through an inlet/outlet port 2. An optical detector 4 is provided at the port 2. When the passbook P or document Q is detected by the detector 4, a shutter gate 3 is opened by an electromagnetic solenoid (not shown), and then the passbook P or document Q are conveyed toward the downstream of the device UM by means of a large number of convey rollers 5*a* and 5*b* driven by a stepping motor 6.

Reference numeral 7 denotes an Automatic Turn Page (ATP) unit having automatic page-turning rollers. When the passbook P passes the port 2 and reaches a magnetic head 8, customer data stored in a magnetic stripe attached to the front and rear covers of the passbook is read in by the magnetic head 8. If the data is determined to be correct, the passbook is taken into the device, whereas if the data is determined to be incorrect or if it is misreaded, the passbook is returned to the ATM 100 through the port 2. When the passbook P of correct data reaches the ATP 7, it is opened by the rollers of the ATP 7, and a page mark and lines in which data are printed are read in by a line finder (L.F) 9. On the basis of a signal supplied from the L.F 9, a printing unit 10 prints data which is omitted or which has been obtained as a result of transaction in the present occasion.

If it is determined that the open page is full, the passbook is returned to the ATP 7, where it is turned to the next page. Then, the L.F 9 detects whether correct page turning is performed. If it is determined that page turning is not performed, the ATP 7 again performs page turning, whereas if it is determined that page turning is performed excessively, the ATP 7 performs to turn page in the backward direction. Thus, the printing unit 10 carries out printing after it confirms correct page turning.

When the passbook P is full of data, i.e., when it has no margin (blank line), a new passbook P1, P2, or P3 is supplied from a passbook supply section 11, 12, and 13. The reason why the handling system has a plurality of passbook supply sections is, for example, that it must deal with various types of passbooks such as a saving account passbook, a general-purpose account passbook, and a passbook dedicated to transfer. If one of the new passbooks P1 is supplied by a forwarding roller 15, the account number, name, etc. of a customer are printed on the cover of a new passbook, and the passbook is opened if necessary. Thereafter, omitted data are printed, and then the passbook is returned to the customer through the inlet/outlet port 2. At the time of issuing a new passbook, the fully printed passbook P is once guided to a passbook retreat section 16, and is then returned to the customer together with the new one.

On the other hand, a single document Q is used at the time of transaction without a passbook. In the embodiment, the document Q is supplied from a fourth supply section 14 only. Specifically, the document Q is taken out of the section 14 by means of a forwarding roller 15*a*, then transferred to the downward side of the device UM, then printed by the printing unit 10, and thereafter discharged. Further, in automatic handling machines installed in banks and, in particular, in stock companies, there is a case where a great amount of messages for each individual must be printed on a document. In this case, all messages may not be printed on a single document Q. To avoid this, a plurality of documents Q on which messages are printed beforehand are contained in a container 17.

In addition, since the device UM is an automatic machine, the document Q and passbook P may be mislaid. In such a case, the device UM will collect them. Specifically, if a timer monitor detects that the document and passbook are mislaid after being discharged, they are transferred through the inlet/outlet port 2 to a gate 18, which is in turn opened to allow them to be guided to a collecting section 20 through collecting passage 19. Reference numeral 21 denotes a power supply, reference numerals 53*a* and 53*b* denotes ink ribbon cassettes, respectively.

Then, the printing unit 10 will be explained in detail with reference to FIGS. 2–6.

Figure 2:
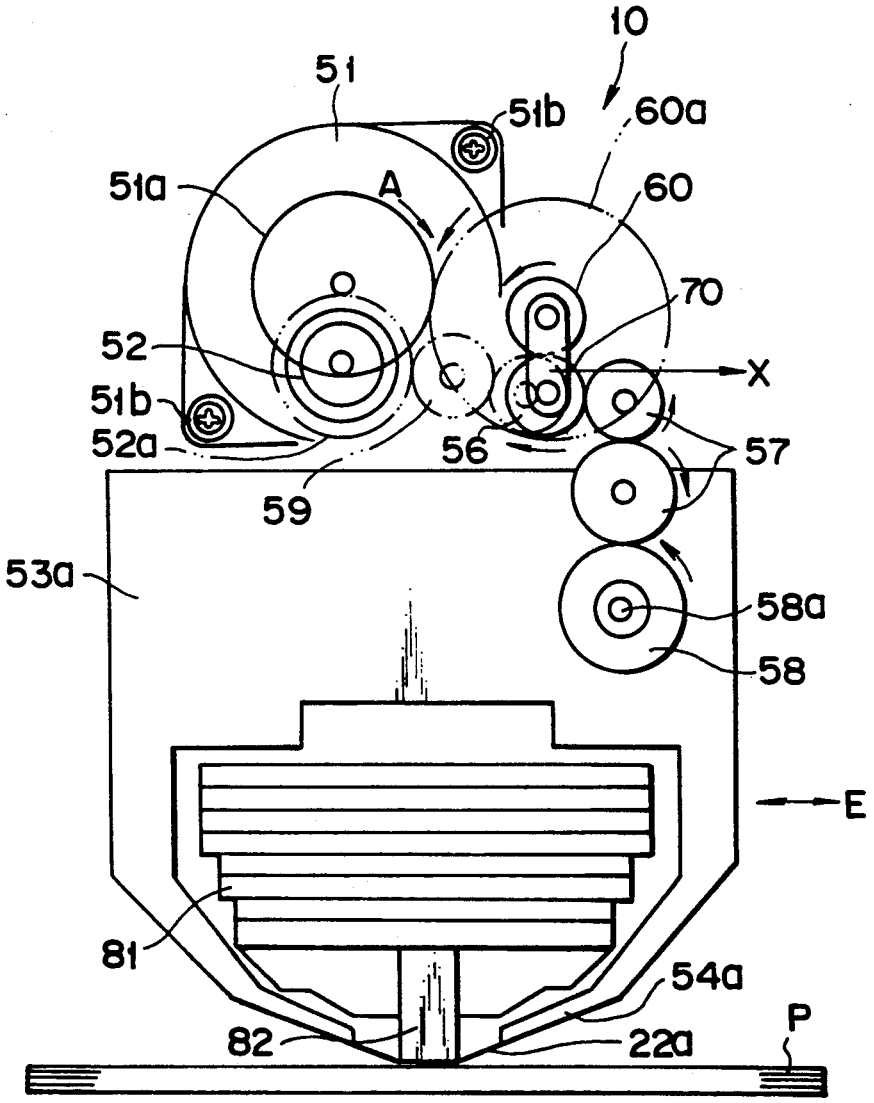
FIG. 2 is a schematic illustration of a printing unit incorporated in a printing apparatus according to the invention, useful in explaining how the elements of the printing unit operate when the driving source of the printing unit is rotated in its forward direction.

FIG. 2 shows the operation of a driving mechanism of the printing unit 10 at the time of taking up an ink ribbon. A motor 51 has a pedestal secured to a carriage 55 by means of a screw 51*b*, and a driving shaft gear 51*a* engaged with a large gear 60*a*. When the gear 51*a* rotates clockwise, i.e., in the direction indicated by the arrow A, coaxial gears 60 and 60*a* rotate counterclockwise. The small gear 60 which is smaller than the large gear 60*a* is coupled with a shift gear 56 by means of a swaying arm 70 such that the small gears 60 and 56 can sway. In the state shown in FIG. 2, the shift gear 56 is engaged with a gear 57 as a result of a friction exerted between the small gear 60 and arm 70 and causing the shift gear 56 to move in the direction indicated by the arrow X. At this time, the shift gear 56 is separated from a gear 59, so that the torque of the gear 56 is transmitted to a ribbon taking-up shaft 58, but not to a shift mechanism having a face cam 52.

Figure 3:
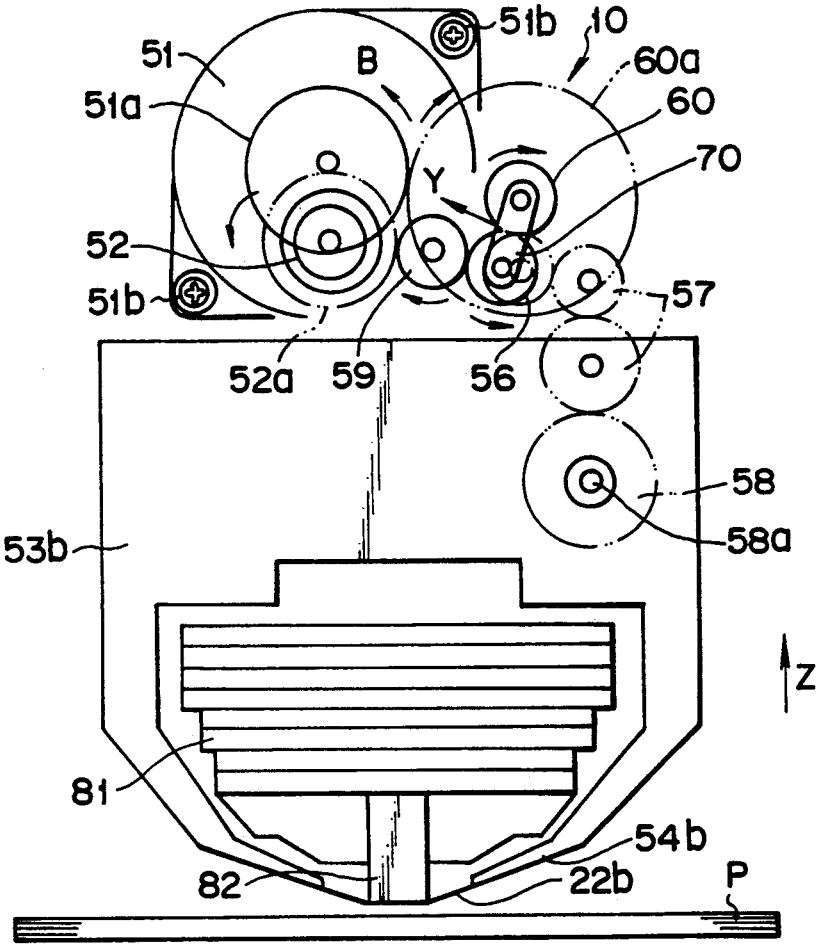
FIG. 3 is a schematic illustration of the printing unit, useful in explaining how the elements of the printing unit operate when the driving source is rotated in its backward direction.
Figure 4:
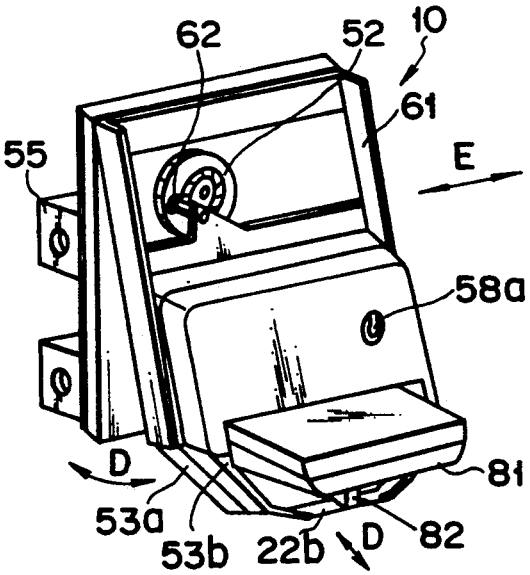
FIG. 4 is a perspective view of the printing unit.

FIG. 3 shows the operation of the driving mechanism of the printing unit 10 at the time of changing ink ribbons, and FIG. 4 is a perspective view of the driving mechanism of the unit 10. When the driving shaft gear 51*a* is rotated in the direction indicated by the arrow B (counterclockwise), the coaxial gears 60 and 60*a* rotate clockwise.

In the state shown in FIG. 3, the shift gear 56 is engaged with the gear 59 as a result of a friction exerted between the small gear 60 and arm 70 and causing the shift gear 56 to move in the direction indicated by the arrow Y. The gear 59 is also engaged with a gear 52*a* being coaxial with the face cam 52 for shifting ribbon cassette. At this time, the shift gear 56 is separated from the gear 57, so that the torque of the gear 56 is transmitted to the ribbon shifting cam 52, but not to the ribbon taking-up shaft 58.

As is shown in FIG. 4, the printing unit 10 is mounted on the carriage 55 such that it can reciprocate in the direction indicated by the arrow E, i.e., in a direction parallel with the ribbon forwarding direction.

Figure 5:
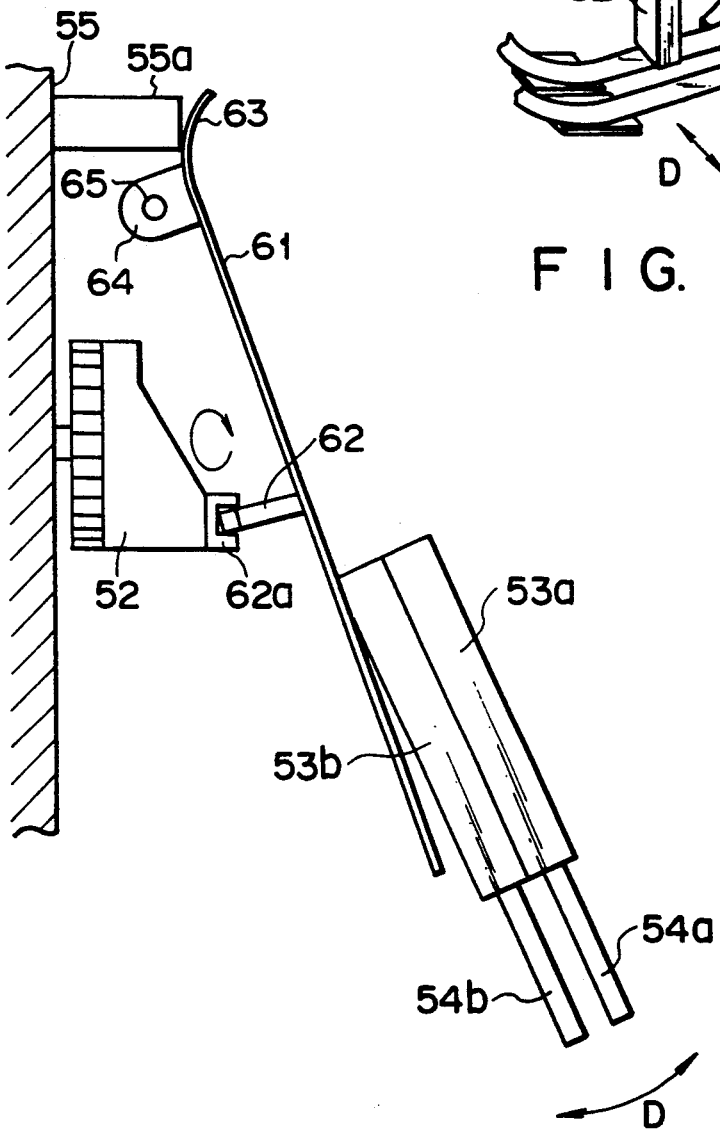
FIG. 5 is a partial side view, showing part of the printing unit.

As is shown in FIGS. 4 and 5, a housing 61 houses two ribbon cassettes 53*a* and 53*b* arranged parallel with each other (overlapped each other). The ribbon taking up shaft 58 is provided for the two ribbon cassettes such that ink ribbons can simultaneously be taken up by the cassettes. As is shown in FIG. 5 (not shown case 81 and printing head 82), the fixed end portion of the housing 61 has a fixed end provided with a blade spring 63. The end of the blade spring 63 is in contact with a member 55*a* of the carriage 55. A bracket 64 and a force pin 62 are secured to the rear surface of the housing 61. A shaft 65 is rotatably secured to the carriage 55, and extends through the bracket 64. The housing 61 can sway about the shaft 65 in the direction indicated by the arrow D. A slide member 62*a* is secured to a tip portion of the force pin 62, and is in contact with the face of the ribbon shifting cam 52. Since the force pin 62 and housing 61 is urged against the cam 52 by means of the blade spring 63, the member 62*a* is urged against the face of the cam 52 at all times.

Figure 6:
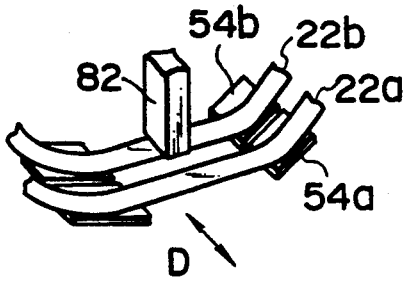
FIG. 6 is a partially expanded perspective view, showing a printing head and ink ribbons incorporated in the printing unit.

When the cam 52 is rotated, the force pin 62 with the housing 61 is moved in accordance with the rotation, thereby swaying the housing 61 and the ribbon cassettes 53*a* and 53*b* secured thereto in the direction D. As a result, as is shown in FIG. 6, the cassettes 53*a* and 53*b* are displaced, and what is positioned directly under the printing head 82 is shifted from one ribbon 22*a* to the other 22*b*. The printing head 82 is of a wire-dot type.

Figure 7:
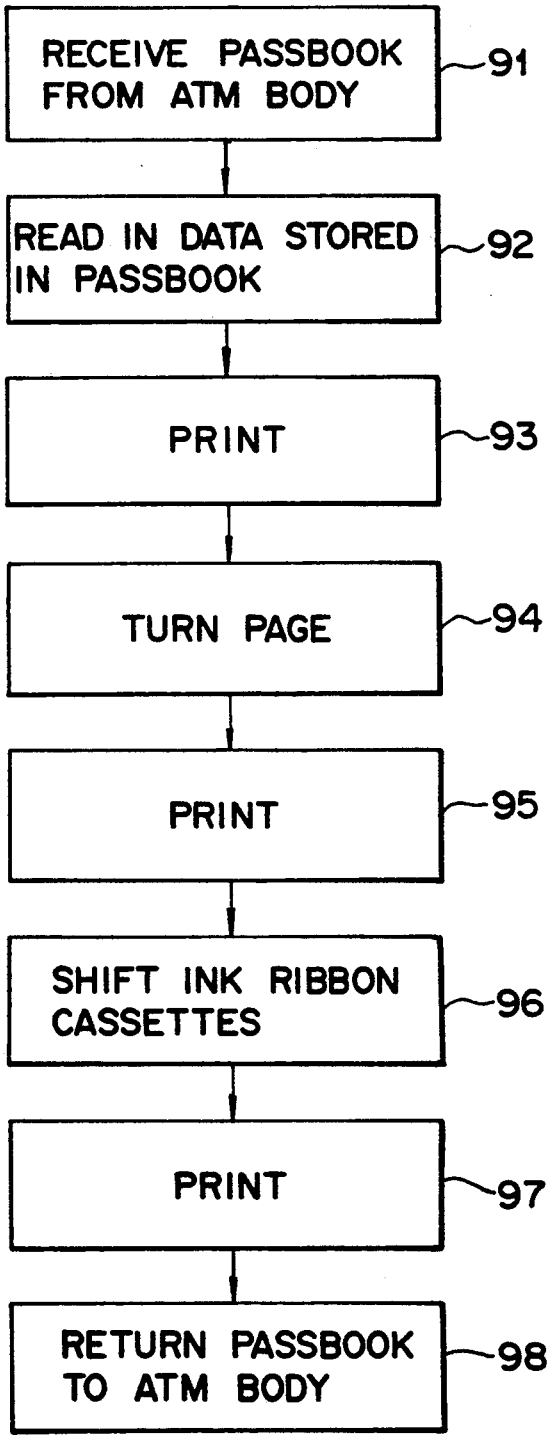
FIG. 7 is a flowchart, showing a manner of printing data on recording sheets by the printing apparatus of the invention.

The operation of the handling system will now be explained with reference to FIGS. 2, 3, and 7.

When the customer inserts his passbook P into the ATM main body 100, the printer system UM receives it (step 91) The L.F 9 reads in the data stored in the passbook P (step 92). The passbook P is transferred to the printing unit 10, and is stopped when that blank line of the passbook P which is first detected by the L.F 9 is positioned directly under the printing head 82. Then, the cassette 53*a* is moved downward together with the carriage 55, thereby urging a black ink ribbon 22*a* against the blank line of the passbook P.

As is shown in FIG. 2, the printing unit 10 is reciprocated in the direction indicated by the arrow E (i.e., in the width direction of the passbook), thereby printing data a blank line of on the passbook P by the use of the black ribbon 22*a*. The ribbon 22*a* is then wound by rotating the driving shaft gear 51*a* in the direction indicated by the arrow A, and thus transmitting torque to the gear train 57 and 58 (step 93).

Each time data is printed on a blank line of the passbook P, the passbook is forwarded in the direction D. When the passbook becomes full, it is returned to the ATP 7, where page turning is performed (step 94).

Thereafter, data is printed on a new page by using the black ink ribbon 22*a* (step 95). When printing using the black ink ribbon has been completed, the printing unit 10 is raised in the direction indicated by the arrow Z in FIG. 3, thereby separating the printing head 82 from the passbook P, as is shown in FIG. 3.

Subsequently, the driving shaft gear 51*a* is rotated in the direction indicated by the arrow B in FIG. 3, thereby transmitting torque to the cam 52 via the shift gear 56. The pin 62 is moved forward by the cam 52, and the ribbon cassettes 53*a* and 53*b* are displaced in arrow D, together with the housing 61. Consequently, as is shown in FIG. 6, a red ink ribbon 22*b* of the cassette 53*b* is positioned directly under the printing head 82 (step 96).

Then, data is printed on a blank line of the passbook P (step 97). When the printing has been completed, the passbook P is returned from the printing unit 10 to the ATM main body 100 through the inlet/outlet port 2 (step 98).

In the system according to the embodiment, the shift gear is rotated in the forward and backward directions by the use of a single driving source, so as to independently operate the ribbon taking-up mechanism and ribbon shifting mechanism. By virtue of the structure, the system can be made compact at low cost.

Further, in the above system, ribbon cassettes corresponding to respective colors are superposed on one another, so that the required size of each cassette is smaller than that of the conventional cassette, and hence the space required for arranging the cassettes is reduced, which enables the system to be made compact.

Also, a common driving source is used for driving the ribbon taking-up mechanism and ribbon shifting mechanism in the system. This being so, the system of the invention can be made small as compared with the conventional system employing two or more driving sources.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A printing apparatus comprising:

driving means including a reversible motor being able to rotate in both a forward direction and a reverse direction;

first transmission means comprising a gear for transmitting torque of the driving means;

second transmission means comprising a gear for transmitting torque transmitted from said first transmission means;

swaying means comprising an arm located at an end of said first transmission means;

means for printing comprising a plurality of ink ribbon cassettes wherein one of said ribbon cassettes is disposed in a printing position to print an image on a recording medium, said ribbon cassettes being connected to one another in a superposed relationship;

ink ribbon take-up means for taking up ink ribbons contained in the ribbon cassettes; and means for changing the position of the ribbon cassettes so as to replace one ribbon cassette with another ribbon cassette in said printing position;

said swaying arm means being able to be swayed so as to be selectively engageable with either said ink ribbon take-up means or said ink ribbon cassette changing means for selectively transmitting the torque from said driving means to either said ribbon take up means or said cassette changing means.

2. The printing apparatus according to claim 1, wherein said changing means includes a face cam to receive the torque of the driving means via the second transmission means, means holding the ribbon cassettes; means for urging the holding member against the face cam, and a force pin secured to the holding means and urged by the urging means against the face cam.

3. The printing apparatus according to claim 2, wherein said urging means is a blade spring.

4. The printing apparatus according to claim 2, wherein the holding member holds two ribbon cassettes.

5. A printing apparatus comprising:

a pair of ribbon cassettes each including a ribbon having printing agents transferable to a recording medium which thereby form an image upon the recording medium;

means for mounting the pair of ribbon cassettes so that one of the ribbon cassettes is located in a print position whereby an image may be formed upon the recording medium;

means for changing the pair of ribbon cassettes so that the other ribbon cassette of said pair is located in a print position whereby an image may be formed upon the recording medium, means for taking up the ribbons contained in the pair of ribbon cassettes;

means for generating a driving force in a forward direction and a reverse direction;

first means for transmitting the driving force in a forward direction to the taking up means; and second means for transmitting the driving force in a reverse direction to the changing means, said changing means including a face cam which pushes the mounting means in response to a rotation created by the driving force generating means, said mounting means including means for holding the pair of ribbon cassettes and means for urging the holding member against said face cam.

6. The printing apparatus according to claim 5 wherein said driving force generating means includes a reversible motor.

7. A printing apparatus comprising:

means for printing having a plurality of ribbon cassettes, said ribbon cassettes having a plurality of ink ribbons disposed therein, one of said ribbon cassettes being disposed in a printing position whereby an image may be printed on a recording medium;

means for taking-up one of said ink ribbons disposed in said one ribbon cassette in the printing position;

means for changing said ribbon cassettes such that another said ribbon cassette assumes the printing position in place of said one ribbon cassette; and means for driving (1) said taking-up means when said driving means rotates in a forward direction and (2) said changing means when said driving means rotates in a reverse direction, said changing means including a face cam being rotated by said driving means, means for holding said ribbon cassettes, means for urging said holding means against the face cam, and a force pin secured to the holding means and urged against the face cam by said urging means.

8. The printing apparatus according to claim 7 wherein said driving means includes:

a reversible motor; and a shift gear connected to the reversible motor for selectively shifting to a first position whereby a driving force is transmitted to a first transmission means and to a second position whereby the driving force is transmitted to a second transmission means, said shift gear shift according to a rotational direction of the reversible motor.

9. The printing apparatus according to claim 7 wherein said plurality of ribbon cassettes are connected to one another such that they can be superposed on one another.

10. The printing apparatus according to claim 7, wherein said driving means includes first transmission means for transmitting torque thereof, a swaying arm provided at an end of the first transmission means, and second transmission means provided at a free end of the swaying arm for transmitting the torque transmitted from the first transmission means to one of said taking-up means and said changing means.

* * * * *